US012305931B2

(12) United States Patent
Shen et al.

(10) Patent No.: US 12,305,931 B2
(45) Date of Patent: May 20, 2025

(54) HEAT EXCHANGER

(71) Applicant: ZHEJIANG SANHUA AUTOMOTIVE COMPONENTS CO., LTD., Zhejiang (CN)

(72) Inventors: Qie Shen, Zhejiang (CN); Jia Zhu, Zhejiang (CN)

(73) Assignee: ZHEJIANG SANHUA AUTOMOTIVE COMPONENTS CO., LTD., Zhejiang (CN)

( * ) Notice: Subject to any disclaimer, the term of this patent is extended or adjusted under 35 U.S.C. 154(b) by 302 days.

(21) Appl. No.: 17/908,347

(22) PCT Filed: Mar. 30, 2021

(86) PCT No.: PCT/CN2021/083705
§ 371 (c)(1),
(2) Date: Aug. 31, 2022

(87) PCT Pub. No.: WO2021/197282
PCT Pub. Date: Oct. 7, 2021

(65) Prior Publication Data

US 2023/0109366 A1 Apr. 6, 2023

(30) Foreign Application Priority Data

Mar. 30, 2020 (CN) ..... 202010238744.2

(51) Int. Cl.
*F28F 9/26* (2006.01)
*F28D 9/00* (2006.01)
(Continued)

(52) U.S. Cl.
CPC ..... *F28D 9/005* (2013.01); *F28D 9/0056* (2013.01); *F28F 3/044* (2013.01); *F28F 3/086* (2013.01);
(Continued)

(58) Field of Classification Search
CPC ..... F28F 9/0207; F28F 9/027; F28F 3/086; F28D 9/005
See application file for complete search history.

(56) References Cited

U.S. PATENT DOCUMENTS 6,244,334 B1 6/2001 Wu et al.
6,863,122 B2 3/2005 St. Pierre et al.
(Continued)

FOREIGN PATENT DOCUMENTS

CN 103328914 A 9/2013
CN 106918165 A 7/2017
(Continued)

OTHER PUBLICATIONS

Translation of JPH11159990A named Translation—JPH11159990A (Year: 1999).*
(Continued)

*Primary Examiner* — Paul Alvare
(74) *Attorney, Agent, or Firm* — Ohlandt, Greeley and Perle, L.L.P.

(57) ABSTRACT

A heat exchanger is provided according to the present application, which includes a core body. The core body includes a first sheet and a second sheet that are arranged in a stacked manner. The core body is provided with a first fluid channel and a second fluid channel that are isolated from one another. The first fluid channel includes a first pore channel and a second pore channel. The core body further includes a first blocking part. The first pore channel includes a first sub-pore channel and a second sub-pore channel. The heat exchanger further includes a first connection port and a second connection port that are located on the same side of the core body in the thickness direction thereof.

15 Claims, 7 Drawing Sheets

(51) Int. Cl.
*F28F 3/04* (2006.01)
*F28F 3/08* (2006.01)
*F28F 9/02* (2006.01)

(52) U.S. Cl.
CPC ..... *F28F 9/26* (2013.01); *F28F 9/0207* (2013.01); *F28F 9/027* (2013.01)

(56) References Cited

U.S. PATENT DOCUMENTS

| | | | | |
|---|---|---|---|---|
| 9,121,643 | B2 * | 9/2015 | Schaefer | H01M 10/6569 |
| 2002/0079093 | A1 * | 6/2002 | Rong | F28F 9/0214 165/174 |
| 2002/0129926 | A1 * | 9/2002 | Yamaguchi | F28D 9/0012 165/41 |
| 2002/0195236 | A1 * | 12/2002 | Bousquet | F28F 9/0246 165/152 |
| 2003/0192677 | A1 | 10/2003 | Rong | |
| 2010/0258285 | A1 * | 10/2010 | Yao | F28F 3/046 165/167 |
| 2011/0198065 | A1 * | 8/2011 | Hanafusa | F28F 9/0209 165/173 |
| 2013/0087317 | A1 | 4/2013 | Papoulis et al. | |
| 2013/0292090 | A1 * | 11/2013 | Haussmann | F28F 3/08 165/96 |
| 2014/0013787 | A1 | 1/2014 | Wesner et al. | |
| 2015/0000869 | A1 * | 1/2015 | Denoual | F28F 3/08 165/96 |
| 2015/0107296 | A1 * | 4/2015 | Lee | F28D 1/05325 62/526 |
| 2015/0233650 | A1 * | 8/2015 | Blomgren | F28F 3/06 165/166 |
| 2016/0282053 | A1 * | 9/2016 | Bardeleben | F28F 9/0258 |
| 2016/0356205 | A1 * | 12/2016 | Braun | F02M 35/10268 |
| 2018/0135916 | A1 * | 5/2018 | Sueyoshi | B60H 1/00342 |
| 2019/0219313 | A1 * | 7/2019 | Draenkow | F28D 9/0056 |
| 2021/0262735 | A1 * | 8/2021 | Yin | F28D 9/0056 |

FOREIGN PATENT DOCUMENTS

| | | | | |
|---|---|---|---|---|
| CN | 110657692 | A | | 1/2020 |
| CN | 212673911 | U | | 3/2021 |
| CN | 212673977 | U | | 3/2021 |
| EP | 1802933 | A | | 7/2007 |
| EP | 1802933 | B1 | | 12/2011 |
| JP | H08271091 | A | | 10/1996 |
| JP | H11159990 | A | * | 6/1999 |
| JP | 2005527768 | A | | 9/2005 |
| KR | 20150098141 | A | * | 8/2015 |
| WO | 2006042405 | A1 | | 4/2006 |

OTHER PUBLICATIONS

Translation of KR20150098141A named Translation—KR20150098141A (Year: 2015).*

Japanese Office Action dated Sep. 12, 2023 for Japanese Appl. No. 2002-545132.

International Search Report dated Jun. 15, 2021 for PCT Appl. No. PCT/CN2021/083705.

European Search Report dated Mar. 25, 2024 for European Application No. 21779922.0.

* cited by examiner

HEAT EXCHANGER

This application is the national phase of International Patent Application No. PCT/CN2021/083705, titled "HEAT EXCHANGER", filed on Mar. 30, 2021, which claims the priority to Chinese Patent Application No. 202010238744.2, titled "HEAT EXCHANGER", filed with the China National Intellectual Property Administration on Mar. 30, 2020, both of which are is incorporated herein by reference.

FIELD

The present application relates to the technical field of heat exchange, and in particular to a heat exchanger.

BACKGROUND

A plate heat exchanger has high heat exchange efficiency, compact structure and relatively light weight, and can be used in many industries such as refrigeration, chemical industry and water treatment. The basic principle of plate heat exchanger is that multiple adjacent and mutually spaced flow channels are formed between multiple heat exchange plates, and two heat exchange media exchange heat through the heat exchange plates in the adjacent flow channels. With the increase in the application scenarios of plate heat exchangers, the performance requirements for plate heat exchangers are also increasing. In a heat exchanger with U-shaped inter-plate channels, although the inter-plate channels are long, this heat exchanger still cannot qualify for some application scenarios with higher performance requirements.

SUMMARY

An object of the present application is to provide a heat exchanger with high heat exchange performance and suitable for most application requirements.

A heat exchanger is provided according to the present application, which includes a core body. The core body includes a first plate sheet and a second plate sheet stacked layer by layer. The core body has a first fluid channel and a second fluid channel which are isolated from each other. The first fluid channel includes a first pore passage and a second pore passage located on the same side in a width direction of the core body. The first fluid channel further includes a first inter-plate channel located between the first plate sheet and the second plate sheet and corresponding to the first pore passage and the second pore passage. The first plate sheet and/or the second plate sheet includes a first isolation portion that separates the first inter-plate channel into a first sub inter-plate channel and a second sub inter-plate channel. The first sub inter-plate channel is in communication with the first pore passage, the second sub inter-plate channel is in communication with the second pore passage. The core body further includes a first blocking portion, and the first pore passage includes a first sub-pore passage and a second sub-pore passage. The first sub-pore passage and the second sub-pore passage are located on two sides of the first blocking portion. The heat exchanger further includes a first port and a second port located on the same side in a thickness direction of the core body. One of the first sub-pore passage and the second sub-pore passage is in communication with the first port, the other of the first sub-pore passage and the second sub-pore passage is in communication with the second port.

In the heat exchanger provided by the present application, the core body further includes the first blocking portion. The first pore passage includes the first sub-pore passage and the second sub-pore passage, and the first sub-pore passage and the second sub-pore passage are located on two sides of the first blocking portion. The heat exchanger further includes the first port and the second port located on the same side in the thickness direction of the core body. One of the first sub-pore passage and the second sub-pore passage is in communication with the first port, the other of the first sub-pore passage and the second sub-pore passage is in communication with the second port. The heat exchange medium forms two substantially opposite flow paths in the upper and lower parts of the core body (in the thickness direction of the core body) located at the first blocking portion, thereby prolonging the flow path, improving the heat exchange performance and being applicable to most application requirements.

Figure 1:
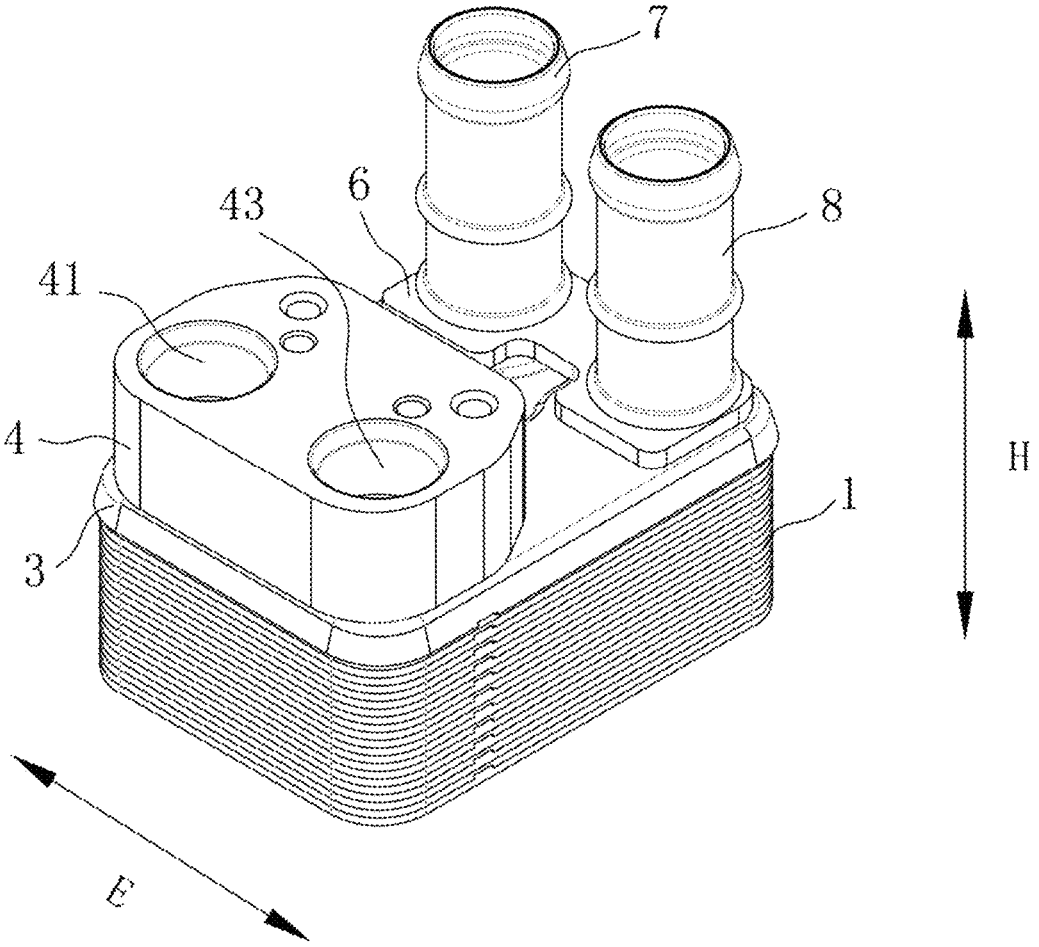
FIG. 1 is a perspective view of a heat exchanger in the present application.

Reference numerals in the drawings are listed as follows:

core body 1, first plate sheet 11, first center bottom 111, first corner hole 112, third corner hole 113, first sub-isolation portion 1141, second sub-isolation portion 1142, first bump 115, first flange portion 116, first corner hole portion 117, second plate sheet 12, second center bottom 121, second corner hole 122, fourth corner hole 123, second bump 124, second flange portion 125, second corner hole portion 126, first pore passage 13, second pore passage 14, first blocking portion 15, second blocking portion 16, third blocking portion 17, inner pipe 2, flange portion 21, end plate 3, third center bottom 31, through hole 32, adapter seat 4, first port 41, boss 42, second port 43, flow guide channel 5, connecting plate 6, first connecting pipe 7, second connecting pipe 8.

DETAILED DESCRIPTION OF THE EMBODIMENTS

In order to enable those skilled in the art to better understand the technical solutions of the present application, the present application will be further described in detail with reference to the drawings and specific embodiments.

In this specification, the terms "up, down, left, right" are established based on the positional relationship shown in the attached drawings, and the corresponding positional relationship may vary with different attached drawings. Therefore, those terms should not be construed as an absolute limitation of the scope of protection. Moreover, the relationship terminologies such as "first", "second", and the like are only used herein to distinguish one element from another having the same name, rather than to necessitate or imply that the actual relationship or order exists between the elements.

Figure 2:
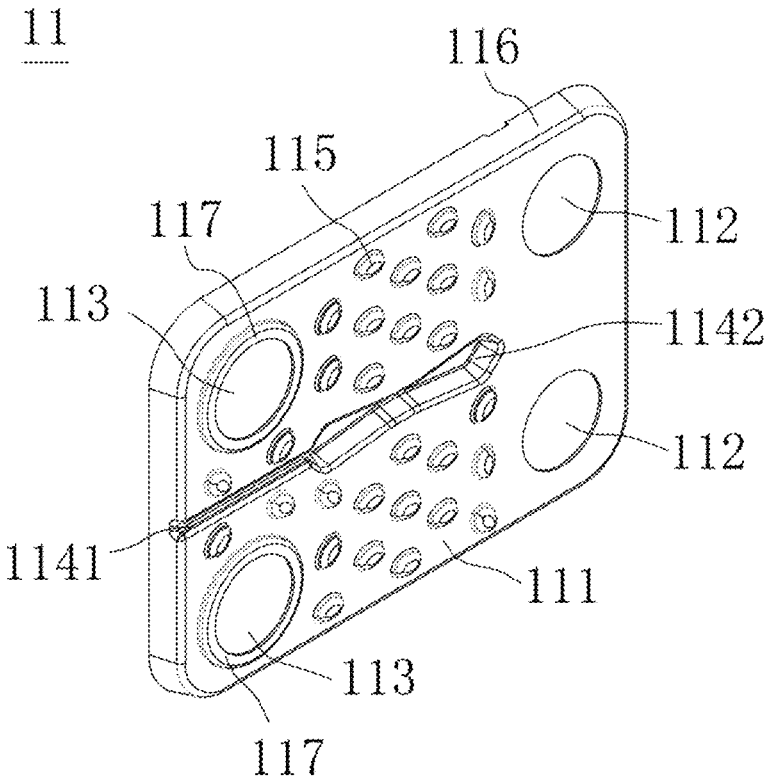
FIG. 2 is a schematic structural view of a first plate sheet in the present application.

Referring to FIG. 2, a first plate sheet 11 includes a first center bottom 111 and a first flange portion 116 disposed along a circumferential direction of the first center bottom 111. The first center bottom 111 is substantially rectangular, and a first corner hole 112 is provided on a short side of the first center bottom 111. The first corner hole 112 is substantially coplanar with the first center bottom 111, that is, the first corner hole 112 is a plane opening. The number of the first corner holes 112 is two, and the two first corner holes 112 are respectively disposed adjacent to the corners of the first center bottom 111 to increase the heat exchange area of the first plate sheet 11 and improve the heat exchange efficiency. The first plate sheet 11 includes a first corner hole portion 117 and a first corner hole connecting portion (not shown in the figure). The first corner hole portion 117 is provided with a third corner hole 113. An outer edge of the first corner hole portion 117 is connected with one end of the first corner hole connecting portion, and another end of the first corner hole connecting portion is adjacent to another short side of the first center bottom 111 and is connected with the first center bottom 111, that is, the third corner hole 113 is a boss opening. The number of the third corner holes 113 is two. The two third corner holes 113 are respectively disposed adjacent to the corners of the first center bottom 111 to increase the heat exchange area of the first plate sheet 11 and improve the heat exchange efficiency.

Figure 4:
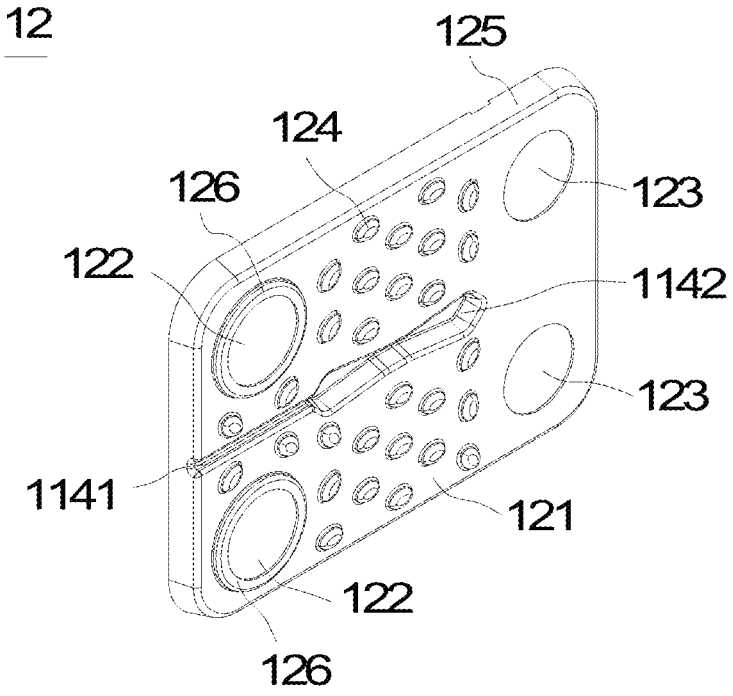
FIG. 4 is a schematic structural view of a second plate sheet in the present application.

Referring to FIG. 4, a second plate sheet 12 includes a second center bottom 121 and a second flange portion 125 disposed along a circumferential direction of the second center bottom 121. The second center bottom 121 is substantially rectangular. The first plate sheet 11 includes a second corner hole portion 126 and a second corner hole connecting portion. The second corner hole portion 126 is provided with a second corner hole 122. An outer edge of the second corner hole portion 126 is connected with one end of the second corner hole connecting portion, and another end of the second corner hole connecting portion is adjacent to another short side of the second center bottom 121 and is connected with the second center bottom 121, that is, the second corner hole 122 is a boss opening. The number of the second corner holes 122 is two. The two second corner holes 122 are respectively disposed adjacent to the corners of the second center bottom 121 to increase the heat exchange area of the second plate sheet 12 and improve the heat exchange efficiency. A fourth corner hole 123 is provided on another short side of the second center bottom 121. The fourth corner hole 123 is substantially coplanar with the second center bottom 121, that is, the fourth corner hole 123 is a plane opening. The number of the fourth corner holes 123 is two. The two fourth corner holes 123 are respectively disposed adjacent to the corners of the second center bottom 121 to increase the heat exchange area of the second plate sheet 12 and improve the heat exchange efficiency.

Figure 8:
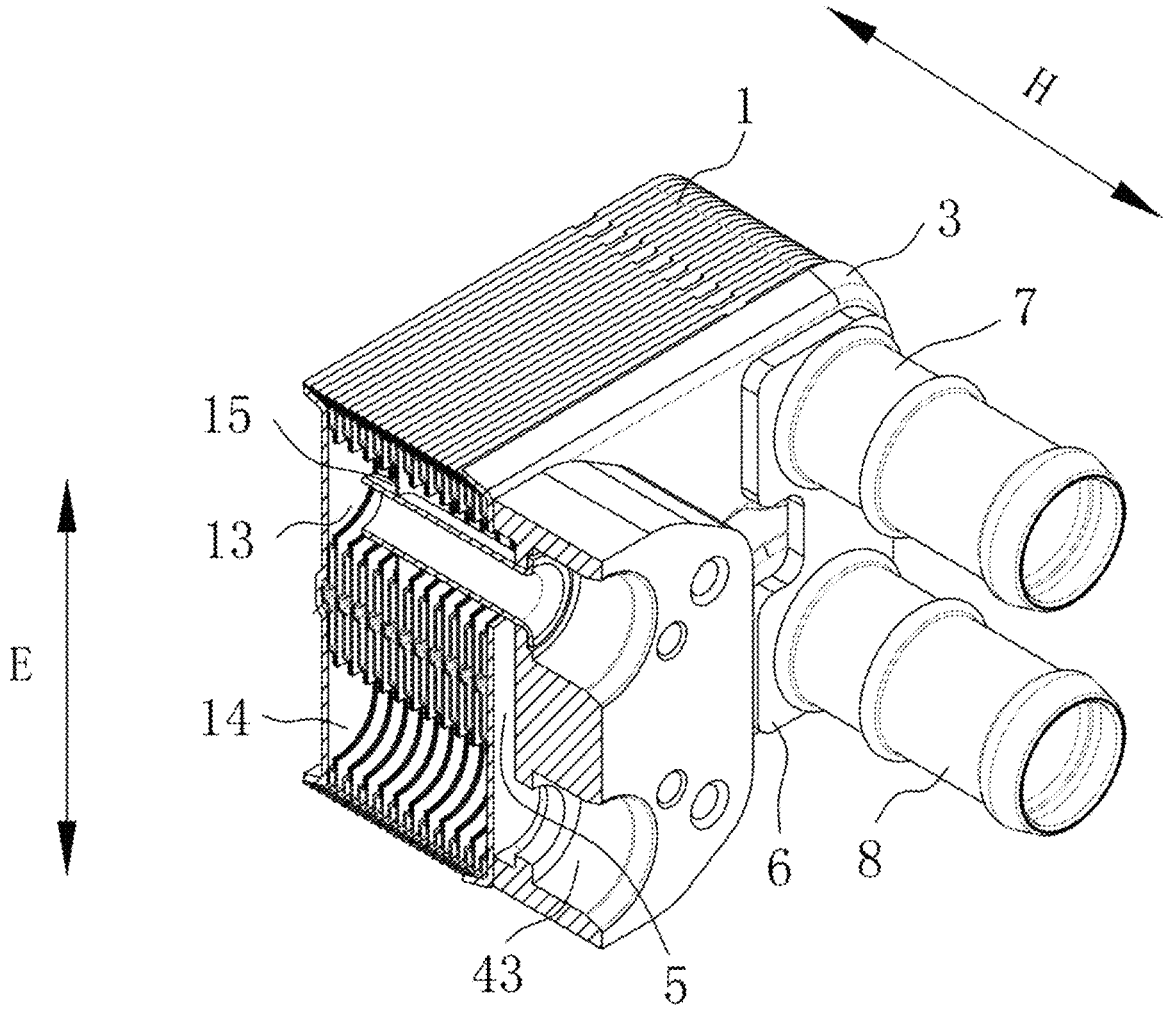
FIG. 8 is a sectional view of the heat exchanger according to an embodiment of the present application.

Referring to FIG. 8, the first plate sheet 11 and the second plate sheet 12 are stacked in sequence to form a core body 1, the first corner hole 112 and the second corner hole 122 cooperate to form a first pore passage 13 and a second pore passage 14. The third corner hole 113 and the fourth corner hole 123 cooperate to form a third pore passage and a fourth pore passage.

Since the first corner hole 112 and the fourth corner hole 123 are plane openings, and, the second corner hole 122 and the third corner hole 113 are boss openings, the first plate sheet 11 and the adjacent second plate sheet 12 are spaced apart, and a first inter-plate channel and a second inter-plate channel are formed between the first plate sheet 11 and the second plate sheet 12. The first inter-plate channel communicates the first pore passage 13 with the second pore passage 14, and the second inter-plate channel communicates the third pore passage with the fourth pore passage. The first pore passage 13, the first inter-plate channel and the second pore passage 14 together form a first fluid channel. The third pore passage, the second inter-plate channel and the fourth pore passage together form a second fluid channel.

Referring to FIG. 2, the first plate sheet 11 is provided along its length direction with a first isolation portion recessed in the first center bottom 111. The first isolation portion includes a first sub-isolation portion 1141 and a second sub-isolation portion 1142 which are connected in sequence. A depth of the first sub-isolation portion 1141 is smaller than a depth of the second sub-isolation portion 1142. The first flange portion 116 includes a first sub-flange portion located on the short side of the first center bottom 111 adjacent to the first corner hole 112, and a second sub-flange portion located on the short side of the first center bottom 111 adjacent to the third corner hole. A free end of the first sub-isolation portion 1141 (the end not connected to the second sub-isolation portion) is connected to the first sub-flange portion. A first gap (not shown in the figure) is provided between a free end of the second sub-isolation portion 1142 (the end not connected to the first sub-isolation portion) and the second sub-flange portion. The second sub-isolation portion 1142 has a dumbbell-shaped structure with two end portions thereof wider than the middle portion thereof. The second sub-isolation portion 1142 can function to guide the fluid, which is conducive to the even distribution of fluid and has low flow resistance and can improve the heat exchange performance. In this embodiment, the width of two end portions of the second sub-isolation portion 1142 is greater than the width of the first sub-isolation portion 1141. In this arrangement, the heat exchange area of a portion between the two first corner holes 112 is large, which is conducive to improving the heat exchange performance of the heat exchanger.

Referring to FIG. 4, the second plate sheet 12 is provided along its length direction with a first isolation portion recessed in the second center bottom 121. The first isolation portion includes a first sub-isolation portion 1141 and a second sub-isolation portion 1142 which are connected in sequence. A depth of the first sub-isolation portion 1141 is smaller than a depth of the second sub-isolation portion 1142. The second flange portion 125 includes a third sub-flange portion located on the short side of the second center bottom 121 adjacent to the fourth corner hole, and a fourth sub-flange portion located on the short side of the second center bottom 121 adjacent to the second corner hole. The free end of the first sub-isolation portion 1141 is connected to the third sub-flange portion. A second gap (not shown in the figure) is provided between the free end of the second sub-isolation portion 1142 and the fourth sub-flange portion.

Referring to FIG. 2 and FIG. 4, when the first plate sheet 11 and the second plate sheet 12 are welded, the second sub-isolation portion 1142 on the first plate sheet 11 is welded to the second sub-isolation portion 1142 on the second plate sheet 12, the first sub-isolation portion on the second plate sheet is welded to the first center bottom to separate the first inter-plate channel into the first sub inter-plate channel and the second sub inter-plate channel. The first sub inter-plate channel and the second sub inter-plate channel are located on two sides of the first isolation portion on the second plate sheet. It is also applicable that the first sub inter-plate channel and the second sub inter-plate channel are located on two sides of the first isolation portion on the first plate sheet by adjusting the positions of the corner holes, which is not repeated here. The heat exchange medium flowing in from the first pore passage 13 passes through the first sub inter-plate channel, the second gap and the second sub inter-plate channel in sequence, and then enters the second pore passage 14, thus forming a U-shaped flow path. Similarly, the second inter-plate channel is divided into a third sub inter-plate channel and a fourth sub inter-plate channel by the first sub-isolation portion. Another heat exchange medium flowing in from the third pore passage passes through the third sub inter-plate channel, the first gap, and the fourth sub inter-plate channel in sequence, and then enters the fourth pore passage, thus forming another U-shaped flow path. In this way, the length of the flow path of the first inter-plate channel and the length of the flow path of the second inter-plate channel in the heat exchanger are increased, and the heat exchange efficiency of the heat exchanger is improved.

Referring to FIG. 2, the first plate sheet 11 further includes multiple first bumps 115 protruding from the first center bottom 111. The first bumps 115 can play the role of guiding flow, and improve the heat exchange performance of the heat exchanger. Most of the first bumps 115 are distributed on two sides of the second sub-isolation portion 1142 of the first plate sheet 11. In this embodiment, the first bumps 115 are evenly distributed on two sides of the second sub-isolation portion 1142 of the first plate sheet 11, and at least part of the first bumps 115 are symmetrically distributed on two sides of the second sub-isolation portion 1142 of the first plate sheet 11. Such an arrangement can improve the flow turbulence of the fluid and further cause the fluid to be evenly distributed, thereby improving the heat exchange performance of the heat exchanger.

Figure 3:
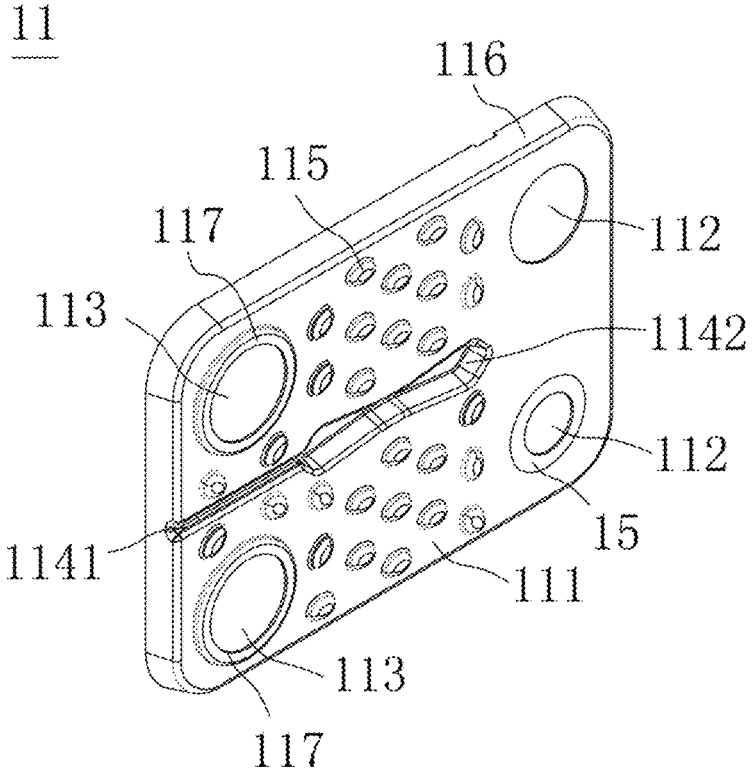
FIG. 3 is a schematic structural view of a sealed connection between the first plate sheet and a first blocking portion in the present application.

Referring to FIG. 3, the second plate sheet 12 further includes multiple second bumps 124 protruding from the second center bottom 121. The second bumps 124 can play the role of guiding flow, and improve the heat exchange performance of the heat exchanger. Most of the second bumps 124 are distributed on two sides of the second sub-isolation portion 1142 of the second plate sheet 12. In this embodiment, the second bumps 124 are evenly distributed on two sides of the second sub-isolation portion 1142 of the second plate sheet 12, and at least part of the second bumps 124 are symmetrically distributed on two sides of the second sub-isolation portion 1142 of the second plate sheet 12. Such an arrangement can improve the flow turbulence of the fluid and further cause the fluid to be evenly distributed, thereby improving the heat exchange performance of the heat exchanger.

Since the first corner hole 112 is located on the short side of the first center bottom 111, and the second corner hole 122 is located on the short side of the second center bottom 121, the first pore passage 13 and the second pore passage 14 are located on the same side in the width direction of the core body 1 (refer to the double-headed arrow E in FIG. 1 and FIG. 8), and, the third pore passage and the fourth pore passage are located on the same side in the width direction of the core body, which is convenient for the installation of the heat exchanger. The first plate sheet 11 and the second plate sheet 12 may be the same. During stacking, the second plate sheet 12 is rotated 180 degrees relative to the first plate sheet 11, so that the first plate sheet 11 and the second plate sheet 12 can use just one set of dies, thus saving the cost. It is also applicable that the first corner hole 112 is a boss opening, the third corner hole 113 is a plane opening, the second corner hole 122 is a plane opening and the fourth corner hole 123 is a boss opening, which is not described in detail here.

Figure 7:
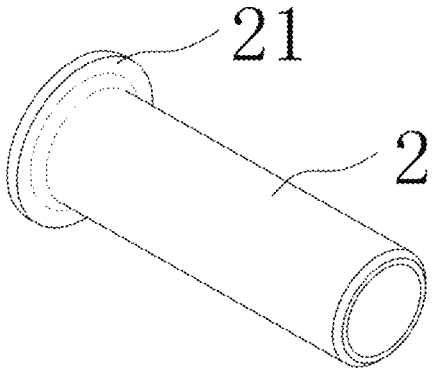
FIG. 7 is a schematic structural view of an inner pipe in the present application.

Referring to FIG. 7 and FIG. 8, the heat exchanger further includes an inner pipe 2, and the core body 1 further includes a first blocking portion 15. A side wall of the first blocking portion 15 is sealingly connected with an inner wall of the first corner hole 112 located in the first pore passage 13, and the first blocking portion 15 has a support hole (not shown in the figure). A diameter of the support hole is smaller than a diameter of the first pore passage 13 (the diameter of the first corner hole 112, where the diameter of the first corner hole 112 and the diameter of the second corner hole 122 are the same). The inner pipe 2 passes through the support hole and an outer wall of the inner pipe 2 is sealingly connected with an inner wall of the support hole, preferably by welding, so as to increase the sealing performance. The inner pipe 2 is in communication with the second sub pore passage. The first plate sheet 11 and the second plate sheet 12 are compressed during the welding process, and the welding position of the first blocking portion 15 and the inner pipe 2 is located on the outer wall of the inner pipe 2. During the welding process, the first blocking portion 15 can move along the outer wall of the inner pipe 2, thus realizing flexible positioning during welding.

The stacking direction of the first plate sheet 11 and the second plate sheet 12 is defined as the thickness direction, as shown by the double-headed arrow H in FIG. 1 and FIG. 8.

In the thickness direction, the second corner hole portion 126 on one second plate sheet 12 is welded with one first plate sheet 11 adjacent to the second corner hole portion 126 and located above the second corner hole portion 126 to form a plate pair. The side wall of the first blocking portion 15 is connected with an inner wall of the first corner hole 112 or an inner wall of the second corner hole 122 in one of the plate pairs. In order to further increase the connection strength of the first blocking portion 15, the outer wall of the first blocking portion 15 is sealingly connected with the inner wall of the first corner hole 112 and the inner wall of the second corner hole 122, which is not further described here.

In the thickness direction, an upper end of the first blocking portion 15 is not higher than an upper end of a corresponding plate plane (the flat part of the first center bottom) of the first corner hole 112, and a lower end of the first blocking portion 15 is not lower than a lower end of the corresponding boss (the second corner hole portion) of the second plate sheet, wherein the second plate sheet 12 and the first plate sheet 11 form one plate pair, so that the first blocking portion 15 does not block the flow surface of the first inter-plate channel, which can effectively ensure the pressure drop of the first inter-plate channel and improve the heat exchange efficiency.

Further, the first blocking portion 15 and the first corner hole 112 or the second corner hole 122 located in the first pore passage 13 are one piece, which increases the sealing effect, simplifies the assembly process and saves the cost.

A first sub-pore passage is formed between the outer wall of the inner pipe 2 located above the first blocking portion 15 and the inner wall of the first pore passage 13. The outer wall of the inner pipe 2 located below the first blocking portion 15, the inner wall of the first pore passage 13, and a part of the first pore passage 13 located below the bottom end of the inner pipe 2 form a second sub-pore passage. The bottom end of the inner pipe 2 is in communication with the second sub-pore passage, and the length of the inner pipe 2 extending into the second sub-pore passage is equal to the length (the distance between the first blocking portion 15 and the bottom end of the first pore passage 13) of the second sub-pore passage, thereby improving the heat exchange efficiency. In the thickness direction, the first sub-pore passage is located above the second sub-pore passage. The first blocking portion 15 divides the core body 1 into two heat exchange parts, the two heat exchange parts are first heat exchange part and second heat exchange part respectively. The first heat exchange part is the part of the core body 1 located above the sealed connection between the first blocking portion 15 and the inner pipe 2. The second heat exchange part is the part of the core body 1 located below the sealed connection between the first blocking portion 15 and the inner pipe 2.

Figure 5:
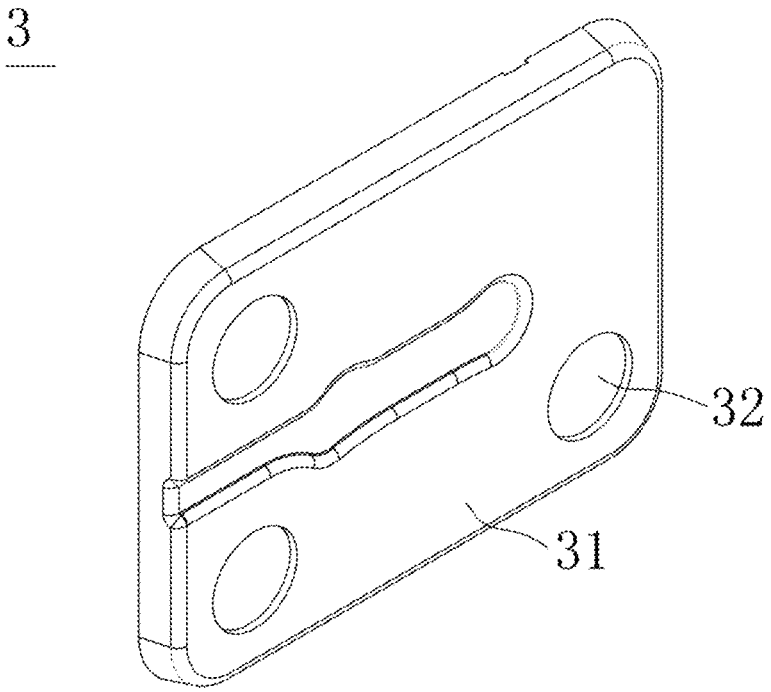
FIG. 5 is a schematic structural view of an end plate in the present application.
Figure 6:
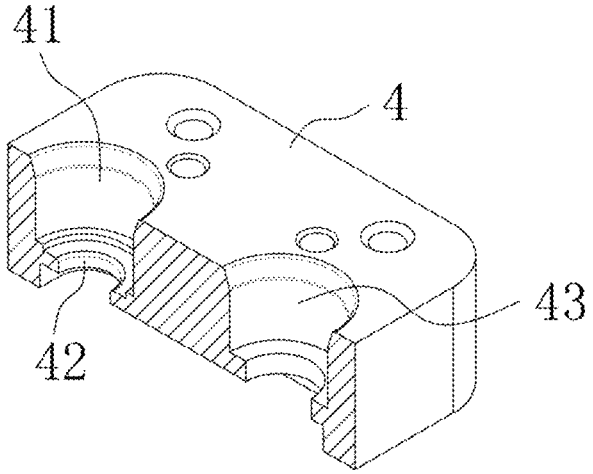
FIG. 6 is a sectional view of an adapter seat in the present application.

Referring to FIG. 5, the heat exchanger further includes an end plate 3 and a top plate (not shown in the figure). The end plate 3 is arranged on the top of the core body 1, and the end plate 3 includes a through hole 32, and the through hole 32 is aligned with the first pore passage 13. The inner pipe 2 passes through the through hole 32, and an annular channel (not shown in the figure) is formed between the inner wall of the through hole 32 and the outer wall of the inner pipe 2. The annular channel communicates a second port 43 with the first sub-pore passage, a part of the end plate 3 opposite to the second pore passage 14 blocks the corresponding end of the second pore passage 14. The top plate is arranged at the bottom of the core body 1. A part of the top plate opposite to the second pore passage 14 blocks another end of the second pore passage 14. A part of the top plate opposite to the first pore passage 13 blocks the end of the first pore passage 13 away from the through hole 32.

Referring to FIG. 6 to FIG. 9, the heat exchanger further includes an adapter seat 4. The adapter seat 4 is fixed to the end plate 3 by welding, and the adapter seat 4 is provided with a first port 41 and a second port 43 along the thickness direction. The inner pipe 2 communicates the second sub-pore passage with the first port 41, and the annular channel communicates the first sub-pore passage with the second port 43. The adapter seat 4 is further provided with an annular boss 42, and the boss 42 extends from the inner wall of the first port 41 towards the central axis of the first port 41. The top of the inner pipe 2 is provided with a flange portion 21 protruding outward. The bottom of the inner pipe 2 is passed through the first port 41, and the flange portion 21 is sealingly connected with the boss 42 to prevent the inner pipe 2 from further moving toward the bottom of the core body 1, and facilitate the installation of the inner pipe 2. Preferably, the flange portion 21 is fixed to the boss 42 by welding, improving the sealing between the inner pipe 2 and the adapter seat 4 while reducing the height of the adapter seat 4. The top end of the inner pipe 2 is in communication with the first port 41. Furthermore, the inner diameter of the inner pipe 2 is in interference fit with the inner diameter of the boss 42 to position the inner pipe 2 and prevent the inner pipe 2 from shaking relative to the first pore passage 13 or prevent the flange portion 21 from shifting relative to the boss 42 in the welding process. The shifting may reduce the welding effect. The adapter seat 4 facilitates the installation of external pipelines. Two external pipelines which are respectively communicated with the first port 41 and the second port 43 can be fixedly mounted via a pressing block, which is convenient to mount and saves materials. Besides, it is also suitable for some installation environments where the inlet and outlet are required to be located at the same side.

A flow groove (not shown in the figure) is provided on the side of the adapter seat 4 connected to the end plate 3, and at least a part of the boss 42 is a part of a corresponding bottom wall of the flow groove. One end of the flow groove is in communication with the second port 43, another end of the flow groove is in communication with the annular channel, and a bottom opening of the flow groove is sealed by the end plate to form a flow guide channel 5. Here, the heat exchange medium enters the core body 1 from the first port 41 for heat exchange by way of example, the flow path of the heat exchange medium is as follows: the first port 41→the inner pipe 2→the second sub-pore passage 132→the first inter-plate channel in the second heat exchange part→the second pore passage 14→the first inter-plate channel in the first heat exchange part→the first sub-pore passage→the annular channel→the flow guide channel 5→the second port 43. The flow direction of the heat exchange medium in the first inter-plate channel in the first heat exchange part is substantially opposite to the flow direction of the medium in the first inter-plate channel in the second heat exchange part, forming a dual flow channel. In the case that the first plate sheet 11 and the second plate sheet 12 have the same size (the size of the core body), the length of the flow path of the first inter-plate channel is increased, and the heat exchange efficiency of the heat exchanger is improved. However, those skilled in the art may appreciate that the features associated with the dual channel are also applicable to the second fluid channel. In addition, according to the described principles, for one or two of the two heat exchange media flowing through the heat exchanger, various flow patterns can be formed. The heat exchange medium may also flow into the core body 1 through the second port 43, and the flow path is not repeated here.

Referring to FIG. 1, the heat exchanger further includes a connecting plate 6. The connecting plate 6 is provided along its thickness direction with a first connecting hole (not shown in the figure) and a second connecting hole (not shown in the figure). The first connecting hole is in communication with the third pore passage, the second connecting hole is in communication with the fourth pore passage. The heat exchanger further includes a first connecting pipe 7 and a second connecting pipe 8. An outer wall of the bottom end of the first connecting pipe 7 is sealing connected with an inner wall of the first connecting hole, and the first connecting pipe 7 is in communication with the third pore passage. An outer wall of the bottom end of the second connecting pipe 8 is sealingly connected with an inner wall of the second connecting hole, and the second connecting pipe 8 is in communication with the fourth pore passage. It can be seen from the above description that both the first connecting hole and the second connecting hole mentioned above extend along the thickness direction of the connecting plate 6, and the two connecting holes are arranged along the width direction of the connecting plate or the width direction of the heat exchanger.

Figure 9:
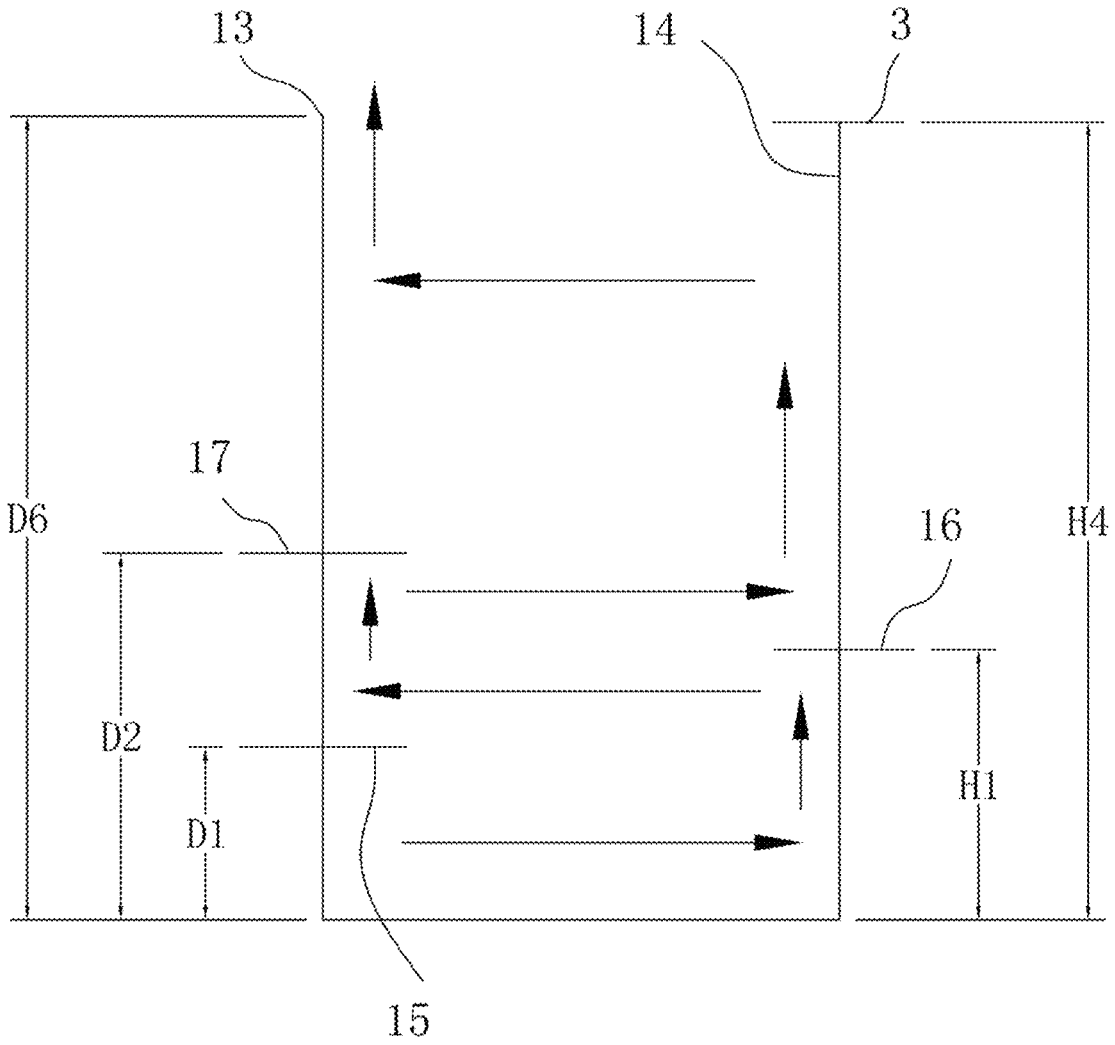
FIG. 9 is a simplified sectional view of the heat exchanger according to another embodiment of the present application.
Figure 10:
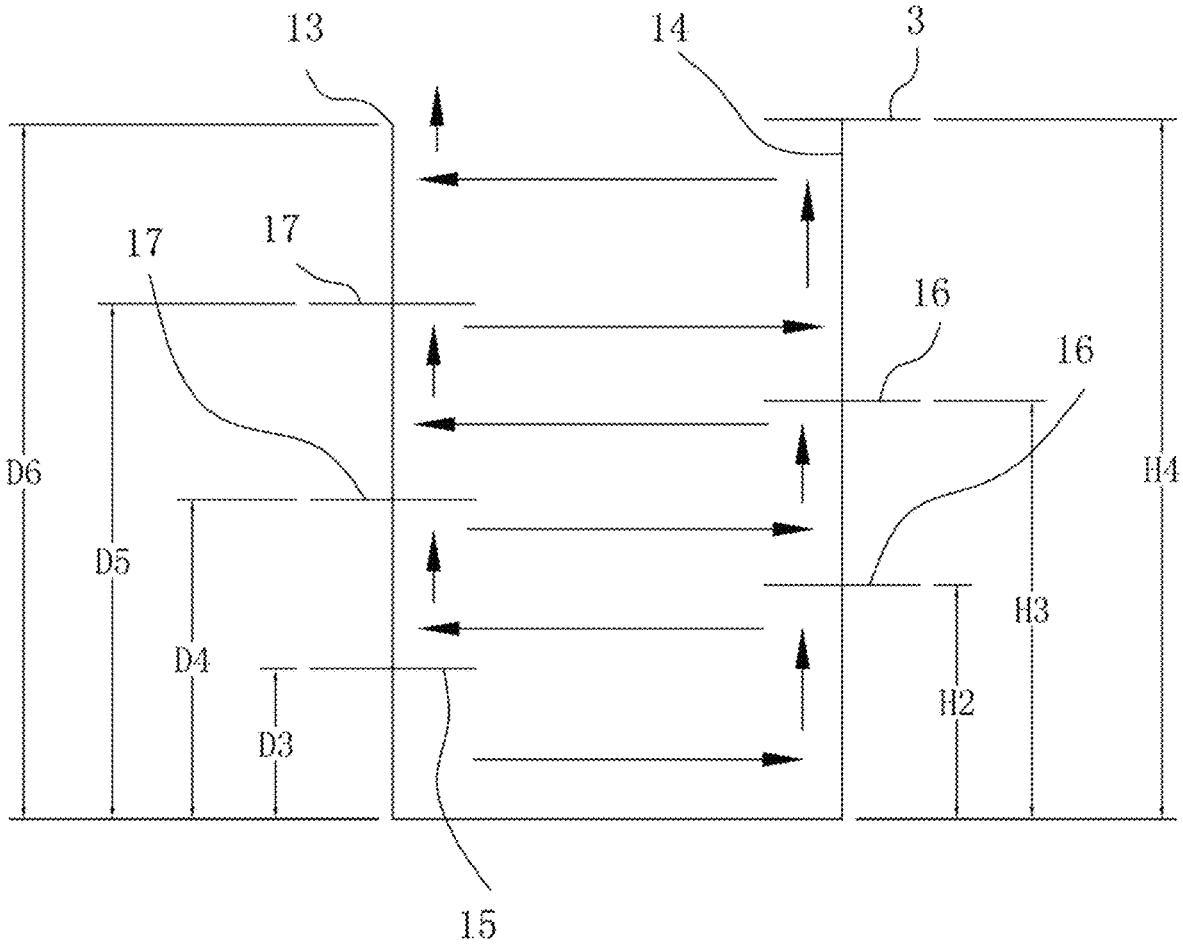
FIG. 10 is a simplified sectional view of the heat exchanger according to yet another embodiment of the present application.

Referring to FIG. 8 to FIG. 10, the heat exchanger further includes a third blocking portion 17. The third blocking portion 17 is disposed in the first pore passage 13, the third blocking portion 17 is located between the first port 41 and the first blocking portion 15. The number of the third blocking portions 17 is N, wherein N 1, the N number of third blocking portions 17 are spaced apart along the first pore passage 13. The heat exchanger further includes a second blocking portion 16. The second blocking portion 16 is disposed in the second pore passage 14, and the number of the second blocking portion 16 is n, wherein N=n. The first blocking portion 15, the n number of second blocking portions 16 and the N number of third blocking portions 17 are arranged along the first sub pore-passage in the width direction of the heat exchanger in a staggered manner.

Referring to FIG. 9, the number of the third blocking portion 17 is one. A sidewall of the first blocking portion 15 is sealingly connected with the inner wall of one of the first corner holes 112, and the sidewall of the third blocking portion 17 is sealingly connected with the inner wall of another first corner hole 112. The distance between the first blocking portion 15 and the bottom end of the first pore passage is D1, and the distance between the third blocking portion 17 and the bottom end of the first pore passage 13 is D2, where D1<D2. The number of the second blocking portion 16 is one, and the side wall of the second blocking portion 16 is similarly sealingly connected with the first pore passage 13 as the first blocking portion 15, which is not be repeated here. The distance between the second blocking portion 16 and the bottom end of the second pore passage 14 is H1, where D1<H1<D2. Further referring to FIG. 10, the number of the third blocking portions 17 is 2, and the outer wall of each third blocking portion 17 is sealingly connected with the inner wall of corresponding first corner hole 112 respectively. The distance between the first blocking portion 15 and the bottom end of the first pore passage 13 is D3, the distance between the third blocking portion 17 adjacent to the first blocking portion 15 and the bottom end of the first pore passage 13 is D4, and the distance between the other third blocking portion 17 and the bottom end of the first pore passage 13 is D5, where D3<D4<D5. The number of the second blocking portion 16 is two, the side wall of each second blocking portion 16 is similarly sealingly connected with the first pore passage 13 as the first blocking portion 15, which is not be repeated here. The distance between the second blocking portion 16 adjacent to the bottom end of the second pore passage 14 and the bottom end of the second pore passage 14 is H2, and the distance between the other second blocking portion 16 and the bottom end of the second pore passage 14 is H3, where D3<H2<D4<H3<D5. The first blocking portion 15, the second blocking portions 16, and the third blocking portions 17 are staggered in the width direction in the above-mentioned manner.

Referring to FIG. 9, the length of the first pore passage 13 is D6, D6-D2>D2-D1>D1, the length of the second pore passage 14 is H4, H4-H1>H1. Referring to FIG. 10, the length of the first pore passage 13 is D6, D6-D5>D5-D4>D4-D3>D3, the length of the second pore passage 14 is H4, H4-H3>H3-H2>H2. That is, in the thickness direction, the lengths of the sub-pore passages in the first pore passage 13 decrease from top to bottom, and the lengths of the sub-pore passages in the second pore passage 14 decrease from top to bottom, which reduces the pressure drop of the heat exchanger and increases the heat exchange efficiency.

The third blocking portion 17 also has a support hole, and the diameter of the support hole of the third blocking portion 17 is smaller than the diameter of the first pore passage 13. The inner pipe 2 is passed through the support hole of the third blocking portion 17 and the outer wall of the inner pipe 2 is sealingly connected with the inner wall of the support hole of the third blocking portion 17. As the end plates of the first sub-pore passage and the second sub-pore passage are sealed with the corresponding parts of the second pore passage 14, is sealingly connected with the upper end of the second pore passage 14, the second port 43 is in communication with the first sub-pore passage through the flow guide channel 5, thus forming a heat exchanger with even number of flow-reversing processes. For example, referring to FIG. 9, when the number of the third blocking portions 17 is one and the number of the second blocking portions 16 is one, the outer wall of the inner pipe 2 between the third blocking portion 17 and the first blocking portion 15 forms a first sub-pore passage a with the first pore passage 13 (not shown in the figure). A first sub-pore passage b is formed between the outer wall of the inner pipe located above the third blocking portion 17 and the first pore passage 13. The sub-passages of the first pore passage 13 are the first sub-pore passage a, the first sub-pore passage b, and the second sub-pore passage. That is, the number of the sub-passages of the first pore passage 13 is three. The second pore passage 14 includes a second sub-pore passage a and a second sub-pore passage b. That is, the number of the sub-passages of the second pore passage 14 is two. The number of sub-passages of the second pore passage 14 is one less than the number of sub-passages of the first pore passage 13. The second sub-pore passage a and the second sub-pore passage b are located on two sides of the second blocking portion 16. Here again, the first port 41 is the inflow port of the heat exchange medium by way of example, the flow path of the heat exchange medium is as follows: the first port 41→the inner pipe 2→the second sub-pore passage→the first inter-plate channel→the second sub-pore passage b→the first inter-plate channel→the first sub-pore passage a→the first inter-plate channel→the second sub-pore passage a→the first inter-plate channel→the first sub-pore passage b→the annular channel→the flow guide channel 5→the second port 43, forming a heat exchanger with four flow-reversing processes.

Referring to FIG. 10, when the number of the third blocking portions 17 is two, and the number of the second blocking portions 16 is two, a first sub-pore passage c is formed between the outer wall of the inner pipe 2 located above the uppermost third blocking portion 17 and the first pore passage 13. The outer wall of the inner pipe 2 located between the two third blocking portions 17 forms a first sub-pore passage d with the first pore passage 13. The outer wall of the inner pipe 2 located between the other third blocking portion 17 and the first blocking portion 15 forms a first sub-pore passage e with the first pore passage 13. That is, the number of sub-pore passages of the first pore passage 13 is four. The second pore passage 14 is divided into a second sub-pore passage c, a second sub-pore passage d and a second sub-pore passage e from top to bottom by two second blocking portions 16. That is, the number of the sub-pore passages of the second pore passage 14 is three. The number of sub-pore passages of the second pore passage 14 is one less than the number of sub-pore passages of the first pore passage 13. Here again, the first port 41 is the inflow port of the heat exchange medium by way of example, the flow path of the heat exchange medium is as follows: the first port 41→the inner pipe 2→the second sub-pore passage→the first inter-plate channel→the second sub-pore passage e→the first inter-plate channel→the first sub-pore passage e→the first inter-plate channel→the second sub-pore passage d→the first inter-plate channel→the first sub-pore passage d→the first inter-plate channel→the second sub-pore passage c→the first inter-plate channel→the first sub-pore passage c→the annular channel→the flow guide channel 5→the second port 43, forming a heat exchanger with six flow-reversing processes.

In summary, the number of flow-reversing processes formed by the heat exchanger is 2N, which is an even number, and can achieve better matching of pressure drop and heat exchange.

The principle and the embodiments of the present application are illustrated herein by specific examples. The above description of the examples is only intended to facilitate the understanding of the concept of the present application. It should be noted that, for the person skilled in the art, various improvements and modifications may be further made to the present application without departing from the principles of the present application, and these improvements and modifications also fall within the scope of claims of the present application.

The invention claimed is:

1. A heat exchanger, comprising a core body, wherein the core body comprises a first plate sheet and a second plate sheet which are stacked layer by layer, the core body has a first fluid channel and a second fluid channel which are isolated from each other, the first fluid channel comprises a first pore passage and a second pore passage located on the same side in a width direction of the core body, the first fluid channel further comprises a first inter-plate channel located between the first plate sheet and the second plate sheet and corresponding to the first pore passage and the second pore passage, at least one of the first plate sheet and the second plate sheet comprises a first isolation portion configured to separate the first inter-plate channel into a first sub inter-plate channel and a second sub inter-plate channel, the first sub inter-plate channel is in communication with the first pore passage, and the second sub inter-plate channel is in communication with the second pore passage, wherein the core body further comprises a first blocking portion, the first pore passage comprises a first sub-pore passage and a second sub-pore passage, the first sub-pore passage and the second sub-pore passage are located on two sides of the first blocking portion, the heat exchanger further comprises an end plate and an adapter seat, the adapter seat is fixed to the end plate, wherein the adapter seat is provided with a first port and a second port located on the same side in a thickness direction of the core body, one of the first sub-pore passage and the second sub-pore passage is in communication with the first port, and the other of the first sub-pore passage and the second sub-pore passage is in communication with the second port, wherein the first blocking portion has a support hole, a diameter of the support hole is smaller than a diameter of the first pore passage; the heat exchanger further comprises an inner pipe, a part of the inner pipe is configured to extend into the first pore passage, the inner pipe is passed through the support hole, and an outer wall of the inner pipe is sealingly connected with an inner wall of the support hole; the inner pipe is configured to communicate the first port with the second sub-pore passage, the first inter-plate channel and the second pore passage are configured to communicate the second sub-pore passage with the first sub-pore passage, and the second port is in communication with the first sub-pore passage, the end plate comprises a through hole, the through hole is aligned with the first pore passage, the inner pipe is passed through the through hole, an annular channel is formed between an inner wall of the through hole and the outer wall of the inner pipe, the annular channel is configured to communicate the second port with the first sub-pore passage, a part of the end plate opposite to the second pore passage blocks a corresponding end of the second pore passage, a flow groove is provided on a side of the adapter seat opposite to the end plate, the flow groove is configured to communicate the second port with the annular channel, the adapter seat is further provided with an annular boss, the boss is configured to extend from an inner wall of the first port toward the central axis of the first port, at least a part of the boss is a part of a corresponding bottom wall of the flow groove, the top of the inner pipe is provided with a flange portion protruding outward, and the flange portion is sealingly connected with the boss.

2. The heat exchanger according to claim 1, further comprising a third blocking portion, wherein the third blocking portion is arranged in the first pore passage, and is located between the first port and the first blocking portion, and a number of the third blocking portion is N, N≥1, wherein the heat exchanger further comprises a second blocking portion arranged in the second pore passage, the first blocking portion, the second blocking portion and the third blocking portion are staggered in the height direction, and a number of the second blocking portion is n, and N=n.

3. The heat exchanger according to claim 2, wherein the third blocking portion has another support hole, the diameter of the another support hole of the third blocking portion is smaller than the diameter of the first pore passage, the inner pipe is passed through the another support hole of the third blocking portion, and the outer wall of the inner pipe is sealingly connected with an inner wall of the another support hole of the third blocking portion, the second pore passage is divided into a plurality of sub-pore passages by the second blocking portion, and a number of the sub-pore passages of the second pore passage is one less than a number of sub-pore passages of the first pore passage.

4. The heat exchanger according to claim 3, wherein the heat exchanger further comprises a top plate, and a part of the top plate opposite to the second pore passage blocks another end of the second pore passage, and a part of the top plate opposite to the first pore passage blocks an end of the first pore passage away from the through hole.

5. The heat exchanger according to claim 4, wherein the adapter seat is fixed to the end plate by welding.

6. The heat exchanger according to claim 1, wherein one end of the inner pipe is configured to extend into the second sub-pore passage after passing through the support hole, and any length within the second sub-pore passage is equal to a length of the inner pipe extending into the second sub-pore passage.

7. The heat exchanger according to claim 3, wherein in the thickness direction, lengths of the sub-pore passages in the first pore passage decrease from top to bottom, and lengths of the sub-pore passages in the second pore passage decrease from top to bottom.

8. The heat exchanger according to claim 1, wherein the first plate sheet comprises a first corner hole, the second plate sheet comprises a second corner hole, the first corner hole and the second corner hole cooperate to form the first pore passage;

a side wall of the first blocking portion is sealingly connected with an inner wall of the first corner hole;

or the side wall of the first blocking portion is sealingly connected with an inner wall of the second corner hole;

or the side wall of the first blocking portion is sealingly connected with the inner wall of the first corner hole and the inner wall of the second corner hole.

9. The heat exchanger according to claim 8, wherein in the thickness direction, an upper end of the first blocking portion is not higher than an upper end of a corresponding plate plane or boss of the first corner hole, and a lower end of the first blocking portion is not lower than a lower end of the corresponding plate plane or boss of the second corner hole.

10. The heat exchanger according to claim 2, wherein one end of the inner pipe is configured to extend into the second sub-pore passage after passing through the support hole, and a length of the second sub-pore passage is equal to a length of the inner pipe extending into the second sub-pore passage.

11. The heat exchanger according to claim 3, wherein one end of the inner pipe is configured to extend into the second sub-pore passage after passing through the support hole, and a length of the second sub-pore passage is equal to a length of the inner pipe extending into the second sub-pore passage.

12. The heat exchanger according to claim 1, wherein one end of the inner pipe is configured to extend into the second sub-pore passage after passing through the support hole, and a length of the second sub-pore passage is equal to a length of the inner pipe extending into the second sub-pore passage.

13. The heat exchanger according to claim 1, wherein one end of the inner pipe is configured to extend into the second sub-pore passage after passing through the support hole, and a length of the second sub-pore passage is equal to a length of the inner pipe extending into the second sub-pore passage.

14. The heat exchanger according to claim 1, wherein in the thickness direction, lengths of the sub-pore passages in the first pore passage decrease from top to bottom, and lengths of the sub-pore passages in the second pore passage decrease from top to bottom.

15. The heat exchanger according to claim 1, wherein in the thickness direction, lengths of the sub-pore passages in the first pore passage decrease from top to bottom, and lengths of the sub-pore passages in the second pore passage decrease from top to bottom.

* * * * *